US006273782B1

(12) United States Patent
Chan et al.

(10) Patent No.: US 6,273,782 B1
(45) Date of Patent: Aug. 14, 2001

(54) WALKING ANIMAL TOY WITH CONTROLLING TETHER

(75) Inventors: Felix Chan, Fullerton; Evelyn Smith-Viohl, Los Angeles, both of CA (US)

(73) Assignee: Mattel, Inc., El Segundo ( * ) Notice: Subject to any disclaimer, the term of this patent is extended or adjusted under 35 U.S.C. 154(b) by 0 days.

(21) Appl. No.: 09/498,419

(22) Filed: Feb. 4, 2000

(51) Int. Cl.[7] ..... A63H 7/00
(52) U.S. Cl. ..... 446/356; 446/377
(58) Field of Search ..... 446/356, 357, 446/355, 354, 353, 339, 376, 377, 385, 396, 325

(56) References Cited

U.S. PATENT DOCUMENTS

| | | | | |
|---|---|---|---|---|
| 3,392,485 | * | 7/1968 | Asano | 446/454 |
| 3,473,258 | * | 10/1969 | Stanzel | 446/454 |
| 3,548,537 | * | 12/1970 | Robbins | 446/355 |
| 3,722,136 | * | 3/1973 | Thorn et al. | 446/353 X |
| 3,762,702 | | 10/1973 | Keele et al. . | |
| 4,135,711 | | 1/1979 | Holt . | |
| 4,141,176 | | 2/1979 | Flicker et al. . | |
| 4,224,759 | * | 9/1980 | Saint-Pierre et al. | 446/353 X |
| 4,398,370 | | 8/1983 | Allen . | |
| 4,545,776 | * | 10/1985 | Law | 446/454 X |
| 4,563,162 | | 1/1986 | Ishimoto . | |
| 4,614,504 | * | 9/1986 | Yamasaki | 446/356 |
| 4,695,266 | * | 9/1987 | Hui | 446/454 |
| 4,878,870 | * | 11/1989 | Pastor | 446/356 X |
| 5,024,626 | * | 6/1991 | Robbins et al. | 446/454 X |
| 5,102,126 | | 4/1992 | Nguyen . | |
| 5,104,344 | | 4/1992 | Jancso, Jr. . | |
| 5,293,712 | | 3/1994 | Lo . | |
| 5,713,780 | * | 2/1998 | Gallagher | 446/377 X |

* cited by examiner

*Primary Examiner*—D. Neal Muir
(74) *Attorney, Agent, or Firm*—Roy A. Ekstrand

(57) ABSTRACT

A walking animal toy includes a battery-powered motor driven apparatus for moving the animal legs to produce a walking action. An independent motor and drive is operative to provide tail wagging of the animal toy. A collar is rotatably secured to the neck portion of the animal toy and receives one end of an elongated flexible tether. The remaining end of the flexible tether is secured to a hand controller including a user handle and a control thumb switch also operable by the user. A plurality of batteries are supported with the hand controller and together with the thumb switch are coupled to the operative mechanism within the animal toy through wires passing through the tether.

5 Claims, 4 Drawing Sheets

80
82
69
63
130
131
154
60
163
153
152
125
150
151
146
66
115
116
105
170
101
145
126
117
143
144
141
160
140
103
98
99
104
142
100
97
106
96
102
110
92
94
171
95
121
90
111
120
122
91
161
71
93
112
123
162
64
70
155
65
157
167
158
166
168
156
165
81

WALKING ANIMAL TOY WITH CONTROLLING TETHER

FIELD OF THE INVENTION

This invention relates generally to battery-powered walking toys and particularly to apparatus for controlling and operating such toys remotely.

BACKGROUND OF THE INVENTION

Battery-powered toys and toy figures are a well known and extremely popular category of toy products. Basically such toys utilize a body or fuselage which supports a plurality of articulated members. A small battery-power source and one or more internal battery-powered motors are utilized for operating the articulated members and providing toy activity. A number of battery powered toys generally described as animal toys have been provided which participate in various activities typical of animals such as walking, jumping or making various sounds. Most such battery-powered toys initially utilized free running or uncontrolled apparatus which simply operated in a continuous manner without user manipulation or control. Later created toys, employed various controlling apparatus such as radio-frequency signal controllers or so-called "remote control". Still others utilized sound or light energy to provide controlling inputs. A different type of remotely controlled animal toy or similar toys such as toy vehicles or airplanes is provided through the use of a connecting cable or tether between a hand-held controller of some type and the toy itself. The direct connection through a tether greatly reduces the cost of the toy and provides easier manipulation and control. For example, U.S. Pat. No. 4,141,176 issued to Flicker et al. sets forth a POSEABLE DOLL, MEANS FOR MOVABLY MOUNTING SAME AND TOY CAMERA having a base supporting a doll in a movable manner. The movement mechanism within the base is coupled to a toy camera by a by a control tether. The user operates the control members on the toy camera on a simulated photo shoot and moves the doll upon the base through the operative tether. U.S. Pat. No. 4,563,162 issued to Ishimoto entitled TOY CAR REMOTELY CONTROLABLE BY FIBER OPTIC MEANS and U.S. Pat. No. 5,024,626 issued to Robbins et al. entitled SOUND PRODUCING REMOTE CONTROL TOY VEHICLE each disclose various toy vehicles utilizing a controlling tether which is operatively coupled to a hand-held control unit.

A number of flying toys, as well as toy which simulate flight utilize various types of control tethers. For example, U.S. Pat. No. 5,104,344 issued to Jancso, Jr. sets forth a LINE CONTROLLED ELECTRICALLY POWERED AIRCRAFT having a toy airplane driven by a propeller which in turn is rotated by a small electric motor. A battery-power source is held by the user and is operatively coupled to the electric motor through the control wires of the hand controlling mechanism for flying the toy.

U.S. Pat. No. 5,102,126 issued to Nguyen sets forth an AIRPLANE FLYING GAME while U.S. Pat. No. 3,762,702 issued to Keely et al sets forth an REMOTE CONTROLLED TETHERED TOY both of which vertically support one or more toy airplanes above the user.

U.S. Pat. No. 4,135,711 issued to Holt sets forth a TETHERED AIRPLANE ASSEMBLY having a center base supporting a vertically extending mast to which a plurality of toy airplanes are operatively connected by controlling tethers.

U.S. Pat. No. 4,398,370 issued to Allen sets forth a SINGLE LINE CONTROL UNIT FOR MODEL AIRCRAFT having a hand controller operatively coupled to a flying toy through a flexible line supported in a similar fashion to a fishing pole and manipulatable as the user draws or releases the control tether from the fishing pole like device.

In a related art, U.S. Pat. No. 5,293,712 issued to Lo sets forth a REMOTE CONTROL FISHING TACLE having a float which controls a fishing line through a remotely controlled base member. The float is battery-powered and includes a plurality of electric motor driven propellers for moving the fish-line about in the water under the control of the base unit.

While the foregoing described prior art devices have to some extent improved the art and have in some instances enjoyed commercial success, there remains nonetheless a continuing need in the art for evermore entertaining, amusing and effective walking toy animals.

SUMMARY OF THE INVENTION

Accordingly, it is a general object of the present invention to provide an improved walking animal toy. It is a more particular object of the present invention to provide an improved walking animal toy which combines aesthetic features with play features to integrate the play features and a controlling tether.

In accordance with the present invention there is provided a walking animal toy comprising: a supporting frame having a toy animal body thereon, the body including a torso, a plurality of legs, a tail and a head including a mouth; a first operative means within the supporting frame for causing the animal toy to walk; second operative means for causing the head to move side-to-side; a collar supported on the body; a hand controller constructed to be held by a user and having a function select switch; a bi-directional motor operating the first operative means in one direction of rotation and the second operative means in the opposite direction of rotation; a control circuit for operating the motor; and a tether coupled between the hand controller and the collar and a plurality of connecting wires passing through the tether coupling the function select switch to the control circuit.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
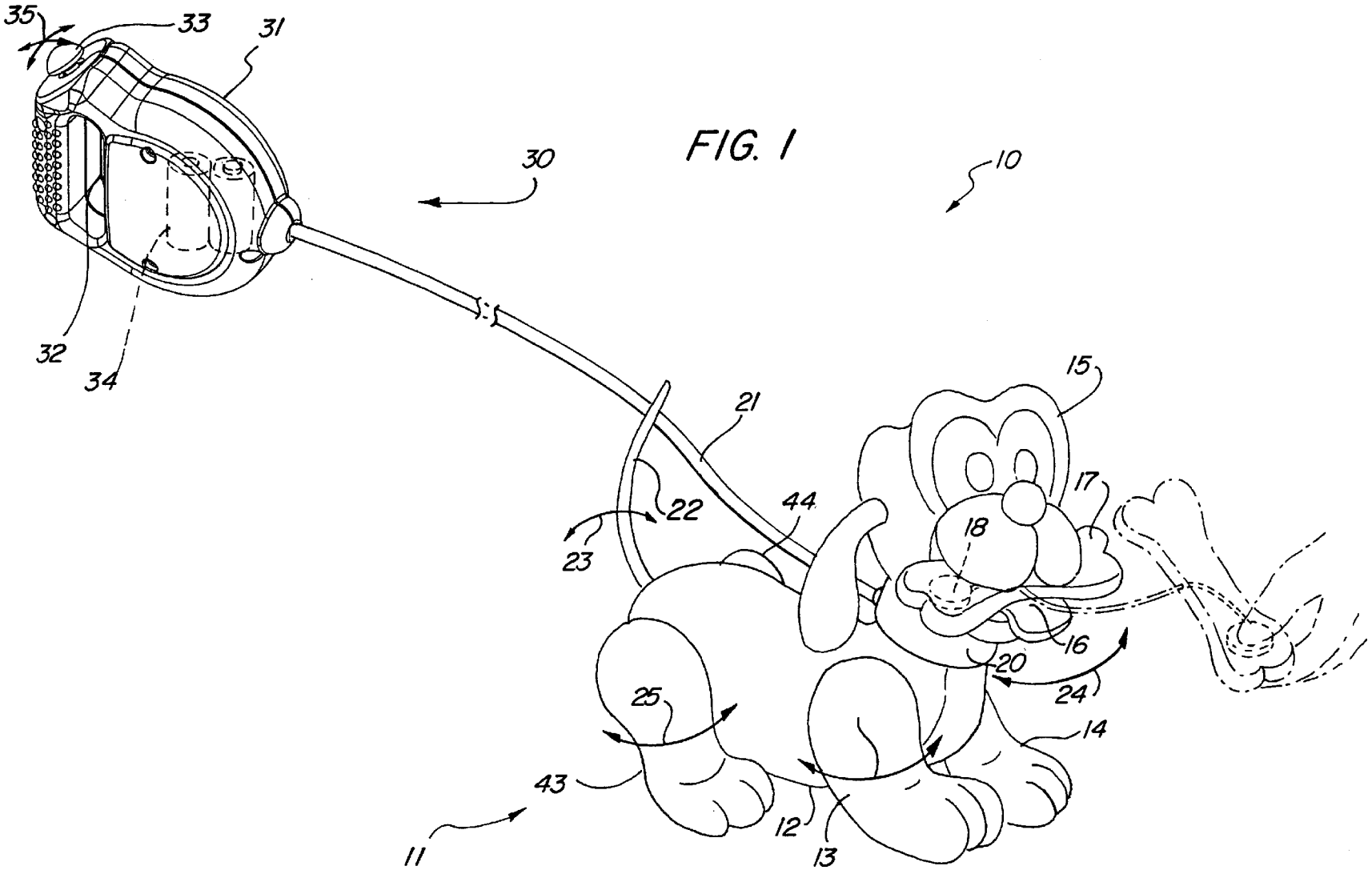
FIG. 1 sets forth a perspective view of a walking animal toy constructed in accordance with the present invention.

FIG. 1 sets forth a perspective view of a walking animal toy constructed in accordance with the present invention and generally referenced by numeral 10. Toy 10 includes an animal 11 formed to resemble a dog having a body 12 supported by legs 13, 14, 43 and 44. Body 12 further includes a head 15 having a mouth 16 formed therein. A simulated bone 17 is secured within mouth 16 and supports a pressure switch 18. Animal 11 further includes a tail 22 extending upwardly from body 12. Animal 11 further supports a generally cylindrical collar 20 about the animals neck which is coupled to a tether 21. The remaining end of tether 21 is coupled to hand controller 30. Hand controller 30 includes a housing 31 having a handle 32 and a thumb switch 33. Housing 31 further supports a plurality of conventional batteries 34. Thumb switch 33 is preferably fabricated to provide a joy stick controller which is movable in four directions from its center rest position as indicated by arrows 35. Thus, thumb switch 33 may be moved forwardly or rearwardly or to the left or to the right imparting different signal conditions to animal 11.

As is set forth below in greater detail, body 12 includes a supporting frame and operative mechanism or skeleton shown in FIG. 2, upon which a soft plush outer body is supported. The shape of body 12 provides animal 11 with a outer appearance which generally resembles a playful dog. However, it will be apparent to those skilled in the art, that animal 11 may be fabricated to present different appearances such as a cat or other pet animal.

In operation, the user holds hand controller 30 and manipulates thumb switch 33 in front-to-back or side-to-side directions to provide electrical signals to animal 11 via tether 21. Such signals are operative in the manner described below to cause animal 11 to walk pivoting legs 12, 13, 43 and 44 in the manner indicated by arrows 25 and arrows 26. This causes animal 11 to walk. Similarly, the user may move thumb switch 33 in a different selected direction causing head 15 to be pivoted rapidly back and forth in the direction indicated by arrow 24. By still further operation and different movement of thumb switch 33, the user is able to cause tail 22 to be rapidly wagged in the directions indicated by arrows 23. Finally, the user may operate thumb switch 33 in a still further alternate direction to activate sound circuit 50 (seen in FIG. 4) to cause animal 11 to emit sounds which in the example shown in FIG. 1 would most likely involve a barking sound typical of a dog. However, other sounds such as growling or the like may be provided without departing from the spirit and scope of the present invention.

In a final play pattern, the user may grip simulated bone 17 held in mouth 16 and squeeze switch 18. The squeezing of switch 18 as the user grips bone 17 activates the mechanism described below which causes head 15 to shake back and forth in the manner indicated by arrows 24. In this manner, a further play activity which simulates a dog fighting or struggling to maintain a mouth grip upon bone 17 is provided.

In accordance with an important aspect of the present invention, the use of hand controller 30, tether 21 and collar 20 in a construction which simulates a conventional leach of the type which would ordinarily be used on a dog or the like, provides an additional amusement to the use tether 21 in addition to providing ease and simplicity of control. Unlike other tethered toys, in which a tether is employed in a manner which seems unnatural to the toy, tether 21 seems entirely natural as providing a leach of the type normally used to walk a dog or similar animal.

Figure 2:
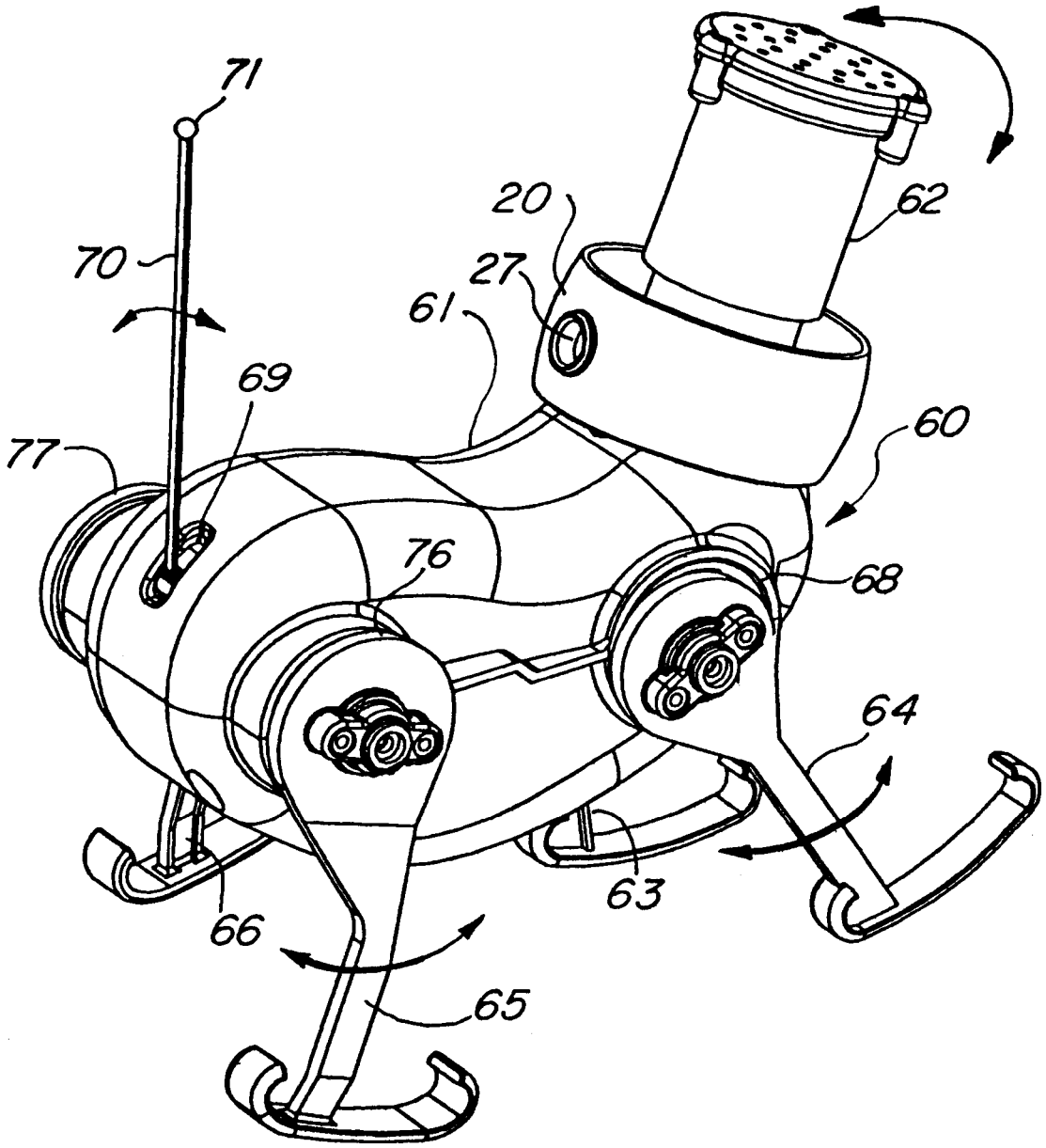
FIG. 2 sets forth a perspective view of the supporting structure and skeleton of the present invention walking animal toy.

FIG. 2 sets forth a perspective of the supporting frame and skeleton of animal 11. The supporting frame and skeleton shown in FIG. 2 is generally referenced by numeral 60 and includes a rigid torso 61 supporting an upwardly extending neck portion 62 and a plurality of leg supports 63, 64, 65 and 66. Leg supports 63 and 64 are pivotally supported upon torso 61 while legs 65 and 66 are similarly supported upon the rear portion of torso 61. For example, leg 64 is supported by a shoulder 68 while legs 65 and 66 are supported by hip joints 76 and 77. While not seen in FIG. 2, leg 63 is supported upon torso 61 by a shoulder joint similar to shoulder joint 68.

In further accordance with the present invention, torso 61 supports collar 20 upon neck 62. Collar 20 defines an aperture 27 which is coupled to tether 21 (seen in FIG. 1). Torso 61 further defines a slot 69 through which a tail staff 70 extends. Tail staff 70 supports tail 22 (seen in FIG. 1) and defines a rounded end 71.

Figure 3:
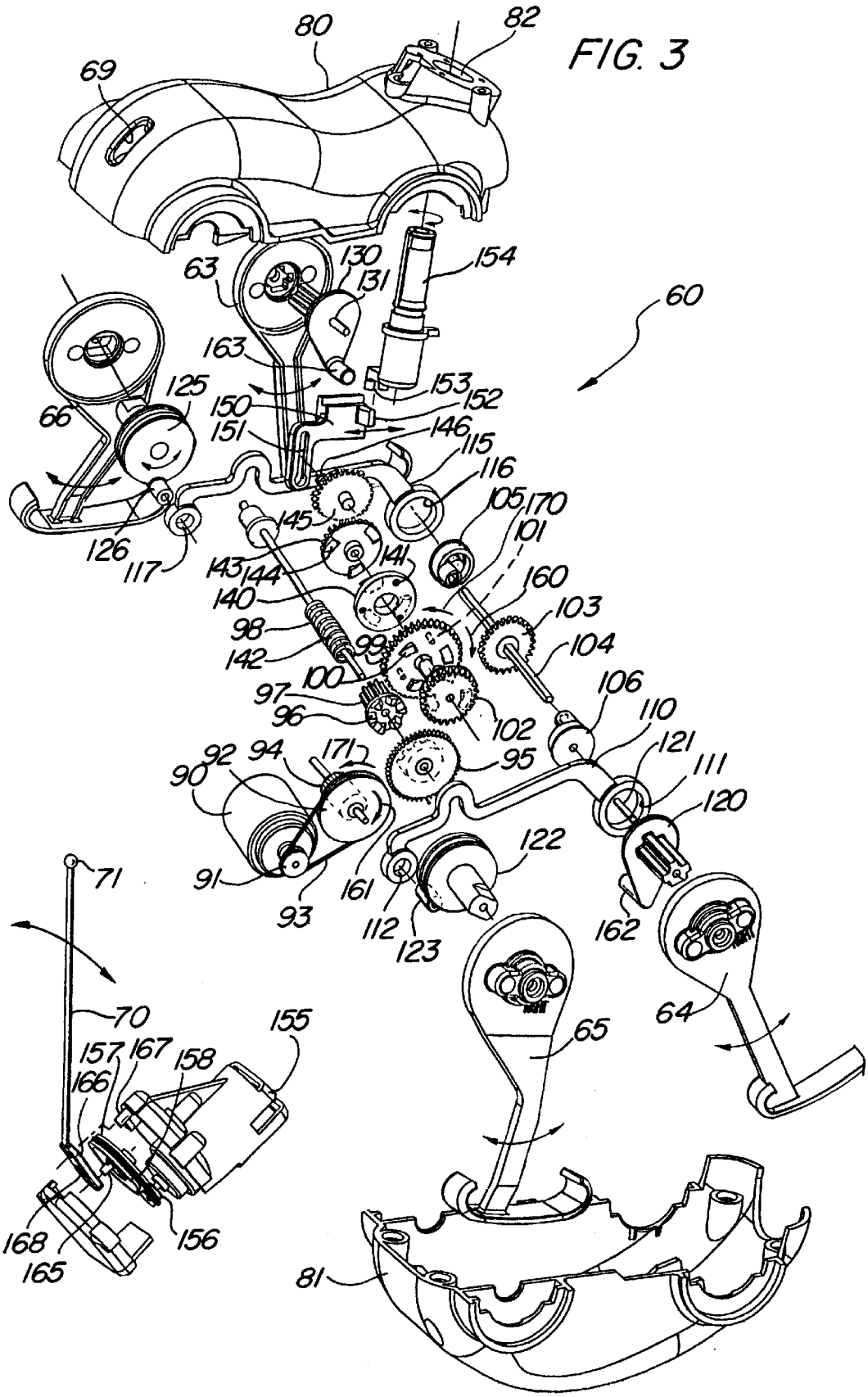
FIG. 3 sets forth a perspective assembly view of the operative drive mechanism within the present invention walking animal toy.

FIG. 3 sets forth a perspective assembly view of the operative mechanism within support structure 60 shown in FIG. 2. Support structure 60 includes an upper housing portion 80 defining a slot 69 and a neck aperture 82 together with a lower housing portion 81. Housing portions 80 and 81 combine to form torso 61 (seen in FIG. 2). A plurality of leg supports 63, 64, 65 and 66 are pivotally supported by upper housing portion 80 and lower housing portion 81. In addition, a neck shaft 54 extends upwardly through aperture 82 and is pivotally supported within upper housing portion 80. Neck shaft 54 is coupled to neck support 62 (seen in FIG. 2) which in turn supports head 15 (seen in FIG. 1).

Support structure 60 further includes a pair of couplers 120 and 130 which engage legs 64 and 63 respectively. Leg coupler 120 includes a pin 121 while leg coupler 130 includes a pin 131. Support structure 60 further includes a pair of rear leg couplers 122 and 125 secured to legs 65 and 66 respectively. Coupler 122 includes an offset post 123 while coupler 125 includes an offset post 126.

Figure 4:
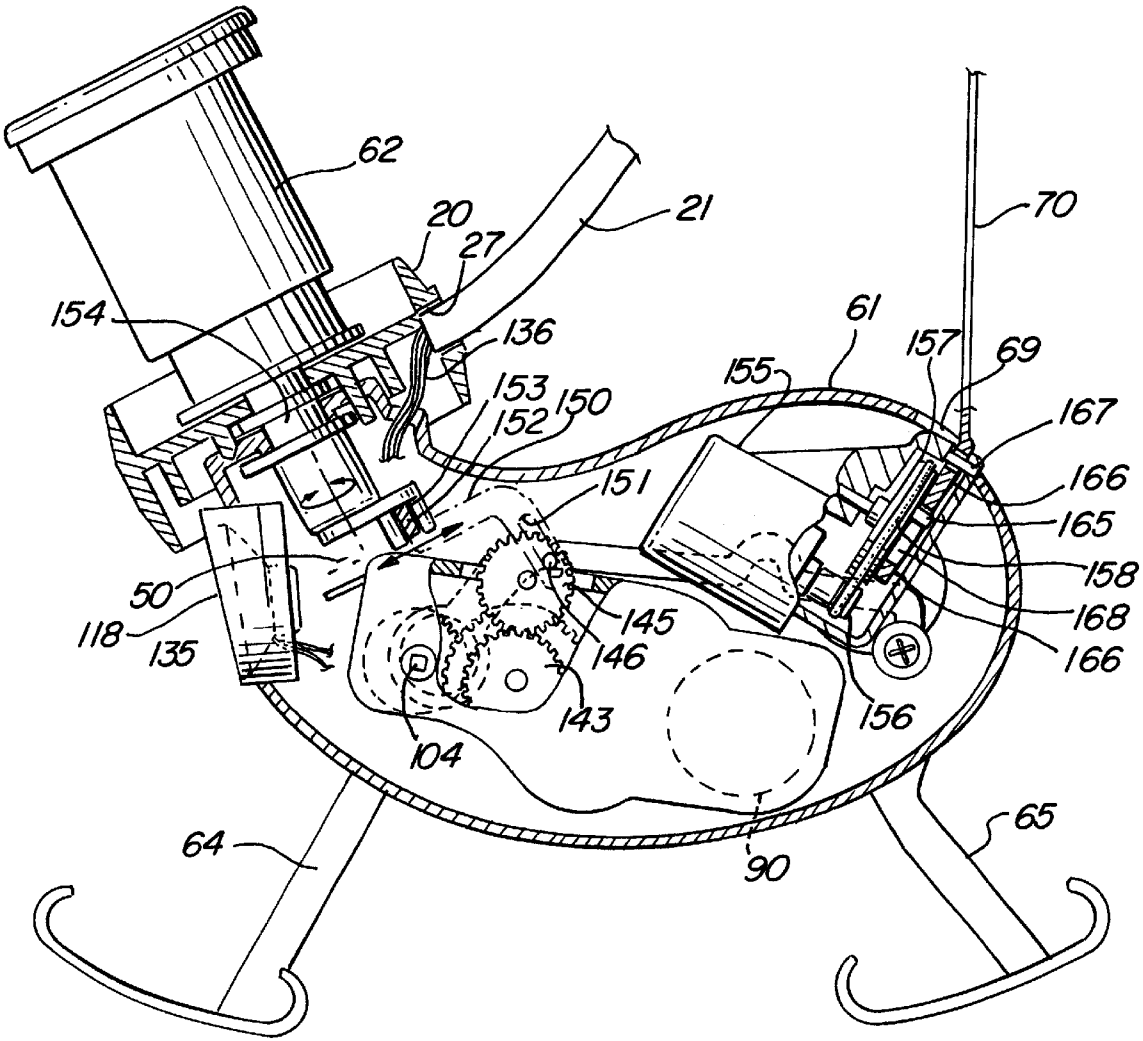
FIG. 4 sets forth a partial section side elevation view of the supporting skeleton and operative mechanism shown in FIG. 2.

Support structure 60 further includes a bi-directional motor 90 operatively coupled to a control circuit 50 (seen in FIG. 4). Motor 90 is coupled to an output pulley 91 which is coupled to a pulley 92 by an endless belt 93. Pulley 92 is joined to a gear 94. Gear 94 engages a gear 95 which is coupled to a clutch mechanism 96. A clutch spring 98 is operative to force member 96 against a cooperating clutch face upon gear 95. Gear 97 is coupled to a gear 99 which supports a plurality of ramp-like teeth 100. Teeth 100 engage a corresponding plurality of teeth formed on a gear 102. Gear 102 engages a gear 103 which is rotatably supported upon a square cross sectioned shaft 104. Shaft 104 is joined to a pair of leg cams 105 and 106. Cam 106 is joined to pin 121 of coupler 120 while cam 105 is joined to pin 131 of coupler 130.

Support structure 60 further includes an elongated link 110 having a ring 111 which is received upon the outer surface of leg cam 106. Link 110 further includes a ring 112. Ring 112 is received upon post 123 of rear ring coupler 122. Similarly, a link 150 includes a ring 116 received upon leg cam 105 and a ring 117 received upon post 126.

Gear 99 further defines a plurality of pins 101 which are received within a plurality of apertures 141 formed in a plate 140. Plate 140 defines a plurality of ramp-like teeth 142. A gear 143 defines a cooperating set of ramp-like teeth 144. Gear 143 engages a gear 145 which further includes an offset pin 146.

A neck link 150 defines an elongated slot 151 which receives pin 146. Link 150 further includes a tooth 152 which is received within a slot 153 formed in neck shaft 154.

In operation, and by way of overview, the operation of the gear drive mechanism within support structure 60 provides either movement of legs 63 through 66 or movement of neck shaft 154 to move head 15 (seen in FIG. 1) depending upon the direction of rotation of motor 90. In this manner, motor 90 and the cooperative gear drive mechanisms coupled thereto may selectively respond to user controls to either move the toy animals head or cause the toy animal to walk.

More specifically, operation of motor 90 in the direction which produces rotation of pulley 92 in the direction indicated by arrow 161, rotates gear 94 and gear 95 which in turn rotates clutch gear 97 causing gear 99 to rotate in the direction indicated by arrow 160. Rotation of gear 99 in the direction indicated by arrow 160 causes teeth 100 of gear 99 to engage the cooperating gears formed on gear 102. This power coupling to gear 102 then rotates gear 103 which in turn rotates square shaft 104. The rotation of square shaft 104 in turn rotates leg cams 106 and 105. The offset structure of leg cams 106 and 105 cooperates with rings 111 and 116 of links 110 and 115 to provide front-to-back oscillatory movement as indicated. The front-to-back movement of links 110 and 115 pivots couplers 120 and 130 about posts 162 and 163. It will be noted while not seen in FIG. 3, posts 162 and 163 are supported within the interior of lower housing portion 81 by conventional attachment (not shown). The pivoting movement of couplers 120 and 130 in turn causes pivotal movement of leg supports 64 and 63 respectively.

Simultaneously, the front-to-back oscillatory movement of links 110 and 115 pivots rear leg couplers 122 and 125 through the offset attachment of posts 123 and 126 within rings 112 and 117. It will be noted that rotation of gear 99 in the direction indicated by arrow 160 produces a corresponding direction of rotation of plate 140. However, due to the angle of teeth 142 of plate 140, no power is coupled between plate 140 and gear 143. Thus, gear 143 does not rotate as motor 90 is driven so-as-to rotate gear 99 in the direction indicated by arrow 160. As a result, neck shaft 154 remains stationary while legs 13, 14, 43 and 44 (all seen in FIG. 1) are moved by leg supports 63, 64, 65 and 66 to provide a walking action for the present invention animal toy.

In accordance with a further advantage of the present invention, the rotation of motor 90 in the opposite direction causing rotation of pulley 92 in the direction indicated by arrow 171, rotates gear 94 causing gear 95 and gear 97 to rotate.

The opposite direction rotation of gear 97 causes gear 99 to rotate in the direction indicated by arrow 170. The attachment between gear 99 and plate 140 provided by pins 101 and apertures 141 causes plate 140 to rotate in the direction indicated by arrow 170. It should be noted, that this opposite direction rotation causes gear 99 to be de-coupled from gear 102 due to the ramp direction of teeth 100 thereon.

The rotation of plate 140 in the direction of arrow 170 causes engagement of teeth 142 and 144 rotating gear 143. As gear 143 rotates, gear 145 is correspondingly rotated resulting in movement of offset pin 146. The movement of offset pin 146 within slot 151 moves neck link 150 back-and-forth as indicated which in turn pivots neck shaft 154 due to the engagement of tooth 152 within slot 153.

Thus, the opposite direction rotation of motor 90, disengages gear 99 from gear 102 while engaging gear 143 through plate 140. As a result, the walking mechanism described above which moves the toy figures legs is inoperative while the head moving mechanism provided by neck shaft 154 is operative. As a result, the opposite direction of rotation of motor 90 produces the above described head shaking motion of the present invention toy animal.

Support structure 60 further includes a motor 155 having an output pulley 156 which is coupled to a pulley 157 by a belt 158. Pulley 157 supports an offset pin 165 which is received within a slot 168 of a follower 166. Follower 166 is pivotally supported upon a pin 167 of motor 155. Follower 166 further supports tail staff 70 having end 71 extending upwardly through slot 69. As a result, the energizing of motor 155 rotates pulleys 156 and 157 moving offset pin 165 within slot 168 causing tail staff 70 to oscillate back-and-forth wagging the tail of the present invention animal toy.

FIG. 4 sets forth a partial section view of the toy animal support structure shown in FIG. 2. As described above, a torso 61 supports a plurality of leg supports such as legs supports 64 and 65 together with a neck support 62. A collar 20 having an aperture 27 formed therein is rotatably secured to neck support 62. A neck shaft 154 extends upwardly from torso 61 and is secured to neck support 62. Neck shaft 154 defines an offset slot 153.

Torso 61 further supports a conventional speaker 118 and a control and sound circuit 50. Speaker 118 is operatively coupled to control and sound circuit 50 by a plurality of connecting wires 135. A further plurality of connecting wires 136 passes through tether 121 and is operatively coupled to control and sound circuit 50.

Torso 61 further supports a motor 155 having an output pulley 156 coupled to a pulley 157 by a belt 158. Pulley 157 further includes an offset pin 165. A pin 167 supports a follower 166 having an elongated slot 168 formed therein. Slot 168 receives pin 65. Follower 166 supports tail staff 70 extending upwardly through slot 69.

A bi-directional motor 90 is supported within torso 61 and by means described above is operative coupled to square shaft 104 and to gear 143 in response to the direction of motor rotation. Gear 143 is coupled to a gear 145 having an offset pin 146 supported thereon. Conversely, shaft 104 is operatively coupled to the above described mechanism which provides leg movement for the present invention animal toy.

A neck link 150 defines an elongated slot 151 which receives pin 146 and a tooth 152 which engages slot 153 of neck shaft 154. Thus, in operation by means described above, rotation of motor 90 in one direction results in walking movement of the present invention animal toy while rotation in the opposite direction of motor 90 produces motion of neck shaft 154 and neck support 62 in the above described head shaking movement of the present invention animal toy.

Energizing of motor 155 rotates pulley 156 and pulley 157 oscillating follower 166 to wag tail staff 70 and produce tail wagging action of the present invention toy.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A walking animal toy comprising:

a supporting frame having a toy animal body thereon, said body including a torso, a plurality of legs, a tail and a head including a mouth;

a first operative means within said supporting frame for causing said animal toy to walk;

second operative means for causing said head to move side-to-side;

a collar supported on said body;

a hand controller constructed to be held by a user and having a function select switch;

a bi-directional motor operating said first operative means in one direction of rotation and said second operative means in said the opposite direction of rotation;

a control circuit for operating said motor; and a tether coupled between said hand controller and said collar and a plurality of connecting wires passing through said tether coupling said function select switch to said control circuit.

2. The walking toy set forth in claim 1 wherein said first operative means includes a first single direction engaging coupler engaging in a first rotation direction and slipping in a second rotational direction.

3. The walking toy set forth in claim 2 wherein said second operative means includes a second single direction engaging coupler engaging in said second rotation direction and slipping in a said first rotational direction.

4. The walking toy set forth in claim 3 further including a toy bone in said mouth having a pressure-responsive switch therein operative to run said motor in said opposite direction of rotation.

5. The walking toy set forth in claim 4 further including a single direction motor and means for wagging said tail.

* * * * *